United States Patent [19]

Candor et al.

[11] 3,967,822

[45] July 6, 1976

[54] METHOD OF MAKING A BALL TEE

[76] Inventors: James T. Candor, 5440 Cynthia Lane, Dayton, Ohio 45429; Joseph V. Tassone, 2425 Rawnsdale Road, Kettering, Ohio 45440

[22] Filed: Oct. 23, 1974

[21] Appl. No.: 517,300

Related U.S. Application Data

[62] Division of Ser. No. 326,806, Jan. 26, 1973, Pat. No. 3,858,879.

[52] U.S. Cl. ..... 273/26 R

[51] Int. Cl.[2] ..... A63B 69/40

[58] Field of Search ..... 273/26 R, 26 E, 26 A, 273/95 A, 33, 200 R, 212; 9/58; 248/38, 43, 132; 272/74; 46/155

[56] References Cited

UNITED STATES PATENTS

| | | | |
|---|---|---|---|
| 2,527,906 | 10/1950 | Bennett et al. | 273/26 R |
| 3,039,770 | 6/1962 | Ferretti | 273/26 R |
| 3,166,316 | 1/1965 | O'Leary | 273/26 E |
| 3,794,320 | 2/1974 | Salmont | 273/26 R |

*Primary Examiner*—Richard C. Pinkham
*Assistant Examiner*—T. Brown
*Attorney, Agent, or Firm*—Candor, Candor & Tassone

[57] ABSTRACT

A ball tee made from a container originally utilized for containing a product with the container having a support and a ball tee operatively interconnected with the support so that when the container is suitably disposed on a support surface the ball tee means will be disposed in an upright manner so that a ball can be hit off of the ball tee by a ball bat, the container is utilized as a support or stabilizing base structure for the upright tee; the container may be a conventional milk bottle or carton or conventional cereal box; with the container supported on a support surface, the upright ball tee is inserted through an opening in the top wall of the container and pushed therethrough until its lower end abuts the bottom wall of the container, the upright tee is made to fit snugly with the aperture in the top wall and is anchored at its lower end to the bottom wall.

10 Claims, 12 Drawing Figures

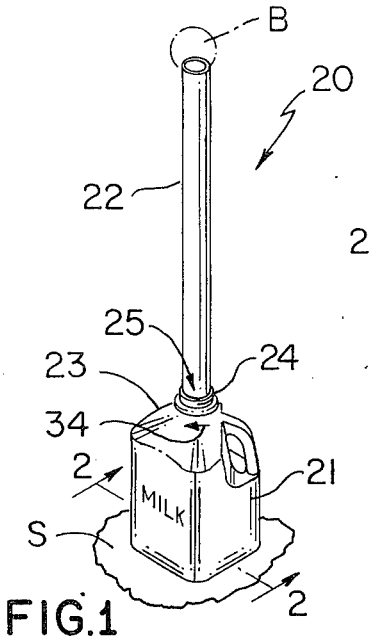
FIG.1
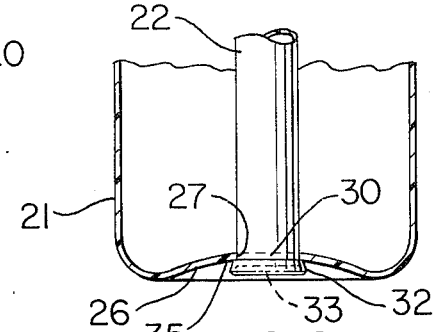
FIG.2
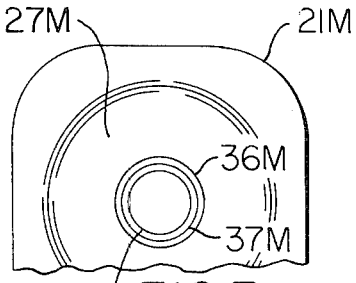
FIG.3
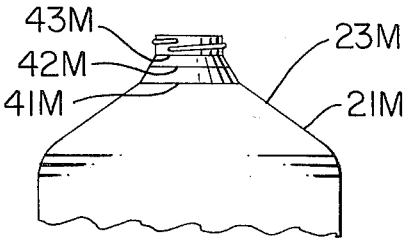
FIG.4
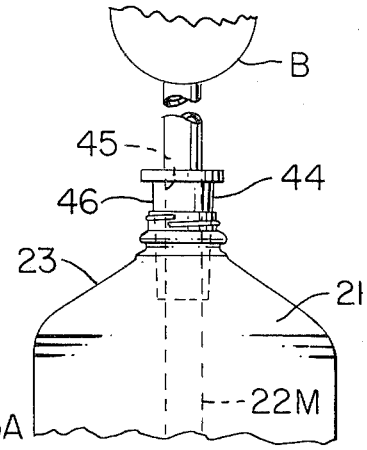
FIG.5
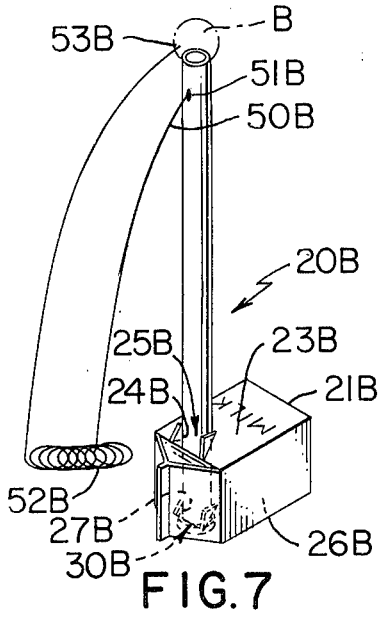
FIG.7
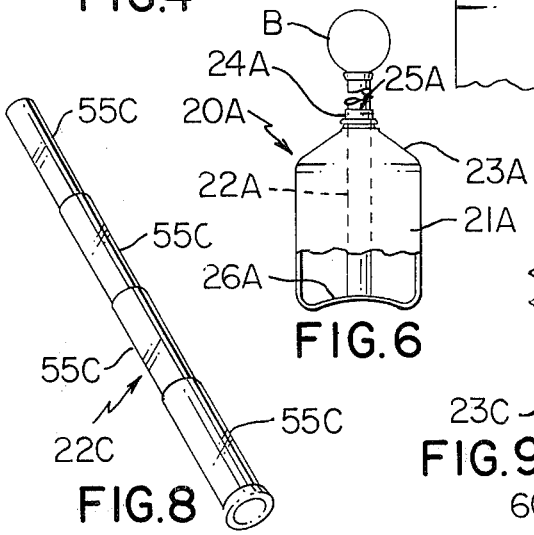
FIG.6
FIG.8
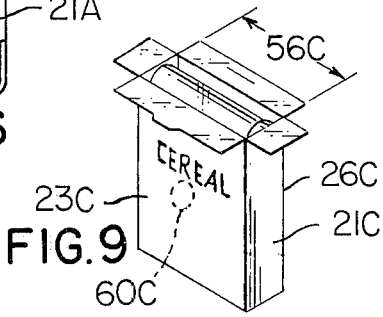
FIG.9
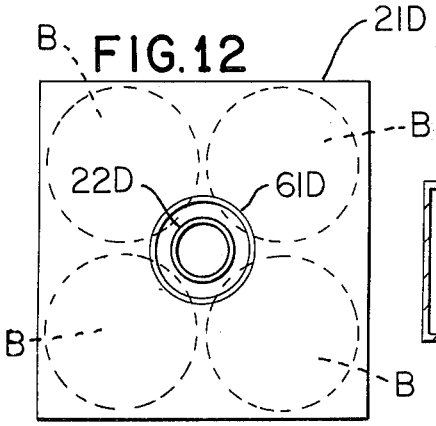
FIG.12
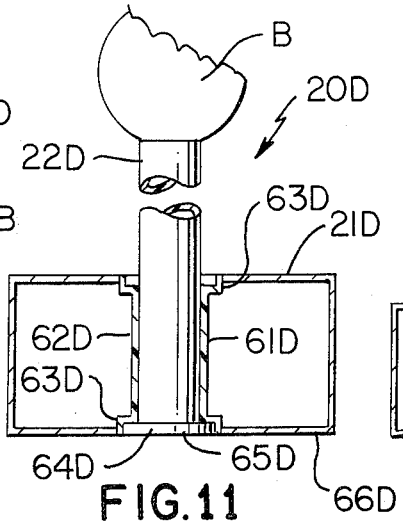
FIG.11
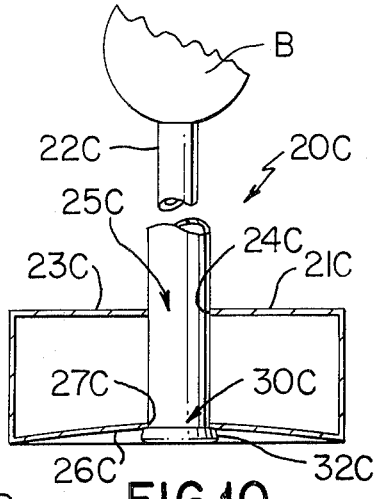
FIG.10

METHOD OF MAKING A BALL TEE

This is a division, of application Ser. No. 326,806, filed Jan. 26, 1973 (now U.S. Pat. No. 3858879).

BACKGROUND OF THE INVENTION

The popularity of ball games such as baseball, softball, and the like, is well known; however, particularly with young children starting at roughly age 5, it is difficult to play these ball games because a pitcher and a catcher are required. At the above-mentioned age and even with some children as old as roughly 10 years of age, it is dangerous to have a catcher stand too close to a young batter swinging a bat because of the poor control which such batter has over the bat. Further, particularly in baseball, young pitchers do not have the ability or physical strength to consistently pitch a ball across home plate to assure that the game will progress at reasonable speed. In addition, with the increased number of arm injuries in recent years, such as so-called "Little League elbow", it is desirable to reduce the pitching stress on the arms of young children.

Therefore, a modified form of baseball, popularly referred to as "tee ball", has been introduced for young children and has had remarkable success. As the name suggests, the game is played with a ball supported on a tee and struck with a bat while the tee is placed on home plate of a regular ball diamond. The ball is usually supported at about waist height to enable the batter to make easy contact with the ball with a smooth, even swing.

With this arrangement the pitcher is not required to pitch the ball and in actual play is required to keep one foot on the pitching rubber until a batter hits the ball, whereupon he may move away from the rubber to field the ball or otherwise assist in defensive play. Similarly, the catcher is required to stand a considerable distance away from the tee on home plate (and a swinging bat) where he is less likely to be injured by the batter. Once the ball is hit, the catcher assumes the normal defensive role of a catcher.

Generally the basic rules which govern play in major league baseball, as played in the United States, apply to teel ball, with modifications such as mentioned above to enable use of a tee. In addition, for young boys the bases are usually 60 feet apart in the usual diamond pattern and the pitcher's rubber is 45 feet from home plate.

In most instances the infield positions are the same as played by major league baseball teams; however, the outfield positions may vary in number from the usual 3 to as many as 5, where it is desired to allow participation by more players. Also, to prevent a particular team from remaining at bat too long, limitations are usually placed as to the number of batters that may bat in a given inning and this number is usually the number of players on the team. Thus, with teams of eleven players each, once the eleventh player comes to bat and regardless of the number of outs prior to that time, after the ball is in play as the result of the eleventh batter's action, all action and scoring are stopped merely by playing the ball home and tagging home plate.

Tee ball games may vary in length to suit local situations; however, they are usually six innings in length, and a complete six inning game with the home team batting in the sixth may be completed usually within roughly one and one-half hours.

It will be appreciated that in order for tee ball to be successful it is necessary to have a tee that a young batter will not be afraid to hit with a regular baseball bat because it might sting his hands. In addition, it is desirable that the tee be such that it supports the ball at a height, in the strike zone, where it may be easily hit with a level swing.

It is generally quite difficult for a young ball player to improve his batting skills for either tee ball or regulation baseball and softball while playing alone and various comparatively expensive ball toss-up devices and stationary tees have been proposed heretofore. These previously proposed ball toss-up devices are generally unsatisfactory because they do not permit a young batter to assume a correct initial stance nor is it possible to teach a young player to move "into the ball" in the desired manner while swinging a ball bat.

Many of the previously proposed stationary tees are categorically unsafe and should not be used. Others of such tees, though safe, may involve considerable expense throughout the course of a baseball season and it is one object of this invention to drastically reduce such expense.

SUMMARY

This invention provides an improved method heretofore unknown which provides a young ball player with means of negligible cost which enables such ball player to improve his or her batting skills by utilizing container means which ordinarily would be discarded.

In particular, this invention provides a method of making a tee which employs a container means that originally was utilized for containing a product means with the container means having support means and a ball tee means operatively interconnected with the support means so that when the container means is disposed on a support surface in certain positions thereon the ball tee means will be disposed in an upright manner so that a ball can be hit off of the same by a ball bat whereby the container means provides a base means for the tee means.

Other details, uses, and advantages of this invention will be readily apparent from the exemplary embodiments thereof presented in the following specification, claims and drawing.

BRIEF DESCRIPTION OF THE DRAWING

The accompanying drawing shows present preferred embodiments of this invention, in which FIG. 1 is a perspective view illustrating one exemplary embodiment of an improved combination defining a ball tee in accordance with this invention;

FIG. 2 is a fragmentary view with parts in cross section and parts in elevation taken essentially on line 2—2 of FIG. 1;

FIG. 3 is a view looking substantially perpendicularly toward the bottom of a container similar to the container of FIG. 1 which has means enabling the cutting of a plurality of openings of different diameters for receiving ball tee means therethrough;

FIG. 4 is a fragmentary view of the upper portion of the container of FIG. 3 and having means enabling the cutting of a plurality of openings having diameters which correspond to the diameters of the openings in the bottom wall;

FIG. 5 is a view with parts in cross section; parts in elevation, and parts broken away of a modification of the ball tee of this invention;

FIG. 6 is a view with parts in cross section, parts in elevation, and parts broken away illustrating another exemplary embodiment of the ball tee of this invention;

FIG. 7 is a perspective view similar to FIG. 1 illustrating another exemplary embodiment of the ball tee of this invention;

FIG. 8 is a perspective view illustrating ball tee means comprised of a plurality of telescoping sections which may be used together with container means originally utilized for containing a product means to define another exemplary embodiment of this invention;

FIG. 9 is a perspective view illustrating the telescoping sections of the ball tee means of FIG. 8 arranged in telescoped relation and packed in the top portion of commonly used disposable container such as a cereal box which may be used as a base for the ball tee means;

FIG. 10 is a view with parts in cross section, parts in elevation, and parts broken away illustrating another exemplary embodiment of the ball tee of this invention made using the component parts illustrated in FIGS. 8 and 9.

FIG. 11 is a view with parts in cross section, parts in elevation, and parts broken away illustrating another exemplary embodiment of a ball tee of this invention which employs container means originally containing product means in the form of a plurality of balls to be used with the ball tee; and FIG. 12 is a top view of the container means defining the base of the ball tee of FIG. 11 showing, by dotted lines, a plurality of four balls in such container means.

DESCRIPTION OF ILLUSTRATED EMBODIMENTS

Reference is now made to FIGS. 1 and 2 of the drawing which illustrates one exemplary embodiment of an improved combination, and method of making same, of this invention which will be referred to generally as a ball tee 20 and is particularly adapted to support a ball B thereon. The ball tee 20 comprises container means or a container 21 that originally was utilized for containing product means and as will be apparent from FIG. 1, the container 21 of this example was originally used for containing milk. The container means or container 21 has support means therein and ball tee means in the form of a ball-supporting member which in this example is a tubular structure or member 22, and the member 22 is operatively interconnected with the support means of container 21 so that when container 21 is disposed on a support surface S, (which may be any ground surface, home plate of a regulation baseball diamond, any indoor floor or surface, etc.) the ball tee means or tubular member 22 will be disposed in a substantially vertical upright manner so that the ball B can be hit off of the tubular member 22 using a ball bat. The ball bat used for this purpose may be in the form of a regulation wooden bat, metal bat, lightweight plastic bat, fiberglas bat or other suitable bat.

The container 21 has upper wall means 23 and an annular surface 24 in such wall means 23 which defines opening means or an opening 25 which is adapted to receive the tubular structure 22 in telescoped relation therethrough.

The container 21 has another wall means or bottom wall 26 which is disposed between the upper wall means or wall 23 and the support surface S and the wall 26 has an annular surface 27 which defines an opening 30 which is particularly adapted to receive the tubular structure 22 therethrough, whereby the tubular structure 22 is supported by the container 21 in two vertically spaced apart locations and may be considered as being supported substantially in two spaced apart horizontal planes.

The tee means or tubular structure 22 has means in the form of a bead-like flange 32 for abutting against the outside outwardly concave surface 35 of the wall 26 to prevent the tubular structure or tee means 22 from being pulled through the container 21 in one direction. The bead-like flange 32 may be defined by flaring the terminal bottom portion of the tubular structure 22 outwardly to define a diameter larger than the diameter of the opening 30. In addition, such bead-like flange 32 may be provided with a reinforcing member in the form of a reinforcing ring 33 which has a terminal outer portion of the material defining tubular structure 22 folded therearound.

It may also be desired, in some applications of this invention, to provide integral means in the bottom wall 26 for fastening the flange 32 tightly against the outside surface of the bottom wall. Such integral means may be in the form of a flange having a roughly L-shaped cross-sectional configuration with the flange 32 being snap-fitted beneath a leg of the L-shaped flange.

The container 21 is shown in FIG. 1 as being in the form of a milk carton and the cross hatching thereof indicates that it is made of an elastomeric material such as plastic, and such plastic material is usually comparatively non-rigid. However, it will be appreciated that the container 21 may be any suitable container made of a non-breakable plastic material or similar material and often commonly used not only to contain milk but also distilled water, products used to launder clothes, fruit juices, and numerous other products whether for commercial or home use. To assist a young batter in the direction in which he or she will hit a ball off of the tee 20 with an associated bat, suitable marking means in the form of lines or arrows 34 may be placed on one or both sides of the container 21. By using a line or arrow 34 a young batter may assume a stance adjacent the tee 20 with an imaginary line adjoining the front tips of the batter's shoes being arranged parallel to the arrow 34 to thereby aid the batter in the direction in which he will hit the ball.

Reference is now made to FIGS. 3 and 4 which illustrate views of a modified container which is designated generally by the reference numeral 21M and such container may be provided with suitable means which may be marking in its bottom wall 26M and its upper wall means or wall 23M for receiving tubular structures similar to the tubular structure 22 and such marking means enable defining associated openings in the associated wall of different diameters. In particular, it will be seen from FIG. 3 that a plurality of three concentric marking means 36M, 37M and 38M are provided in the bottom wall 26M and each of such marking means may be in the form of concentric inked lines, concentric annular ridges having a wall thickness greater than the wall thickness of the wall 26M, or concentric score or weakening means having a wall thickness which is smaller than the thickness of wall 26M. The marking means 36M, 37M, and 38M are adapted to be used with marking means 41M, 42M, and 43M respectively in the upper wall means 23M of the container 21M and as with the marking means 36M, 37M, and 38M the marking means 41M, 42M, or 43M may be inked lines, raised surface means, score means, or the like.

In actual use, once the outside diameter of the tubular structure to be used with container 21M is known, the corresponding marking means in both the bottom wall 26M and the upper wall means 23M is selected and cut to enable such tubular structure to be inserted therethrough so as to provide a comparatively snug fit therebetween and define a tee similar to the tee 20.

Another modification of the tee of this invention is illustrated in FIG. 5 wherein the container 21 is employed together with a structure 22M which is comparatively smaller in diameter than the normal pour opening or spout of the container 21. The structure 22M may be either tubular or solid and employs an adapter 44 which has a right circular cylindrical inside surface 45 which allows comparatively free yet snug sliding movement of the tubular structure 22M therethrough and the adaptor 44 has an outside substantially frustoconical surface 46 which provides a tight fit between the annular surface 24 and the surface 46 to assure the tubular structure 22M is held in an upright manner. With the adaptor 44 a structure 22M may be made comparatively small in outside diameter and utilized with containers having different sized openings through their upper wall means 23 yet a comparatively tight support is provided between the upper wall means 23 of a particular container 21 and its associated tubular structure 22M.

In those instances where the outside diameter of the member 22M is made very small so that it may be employed with containers 21 having comparatively small pour openings through the upper wall means 23 thereof, the structure 22 may be provided, if desired, with suitable (either integral or detachable) cup-like support or the like to enable a ball B to be supported thereon in a more stable manner.

Other exemplary embodiments of tees of this invention are illustrated in FIGS. 6, 7, 10, and 11. The tees illustrated in FIGS. 6, 7, 10, and 11 are similar to the tee 20; therefore, such tees will be designated by the reference numerals 10A, 20B, 20C, and 20D respectively and representative parts of each tee which are similar to corresponding parts of the tee 20 will be designated in the drawings by the same reference numeral as in the tee 20 whether or not such parts are mentioned in the specification and followed by the associated letter designation A, B, C, or D and not the tee 20 will be designated by a new reference numeral also followed by the associated letter designation and described in detail.

The combination defining the tee 20A is shown in FIG. 6 and comprises container means in the form of a container 21A having lower or bottom wall means 26A and upper wall means 23A provided with an annular surface 24A defining an opening 25A through which a ball tee means in the form of a tubular structure 22A is inserted. The bottom edge of the structure 22A rests on the inside surface of the bottom wall 26A.

The ball tee 20B is illustrated in FIG. 7 and is comprised of container means in the form of a usual milk carton 21B made of treated paper, or the like, which has upper wall means 23B and surface means 24B therein which define an opening 25B. The container 21B has another wall 26B arranged opposite wall 23B which is provided with surface means 27B defining another opening 30B and a tubular member or structure 22B is inserted through the openings 30B and 25B and supported by the surface means 27B and 24B whereby structure 22B is supported in a substantially vertical upright manner so that a ball B may be supported thereon in a stable manner.

In some applications of this invention the tubular structure 22B may have one end of a string 50B suitably fastened thereto as shown at 51B and the string 50B may have coil means 52B therein. The opposite end of such string may be tied to the ball B as shown at 53B so that once the ball B is hit from the tee 20B with a ball bat in the usual manner the coil means 52B provided in the string 50B allows the ball to travel a certain predetermined distance depending upon the length of the string whereupon the ball B may be easily retrieved merely by pulling on the end of the string attached to the member 22B and without the need to chase such ball.

The tee 20C is illustrated in FIG. 10 and is comprised of container means or a container 21C, see FIG. 9, originally utilized for containing product means in the form of cereal, or the like, and such container 21C has wall means 23C provided with an annular surface 24C defining an opening 25C therein and has another oppositely arranged wall means 26C provided with an annular surface 27C defining an opening 30C. A structure 22C is inserted through the openings 30C and 25C so that the bottom surface of an annular bead-like flange 32C is substantially coplanar with the plane of the peripheral edge of the bottom wall 26C and the bead-like flange 32C engages the wall 26C at locations adjoining the opening 30C to prevent the tubular structure 22C from pulling through or away from the container 21C.

The structure 22C may be a single piece construction similar to the structure 22 of the tee 20; however, in this example such structure 22C is comprised of a plurality of four cooperating tubular components, see FIG. 8, each designated by the reference numeral 55C which are arranged in telescope relation and are adapted to be telescoped concentrically within each other to define a compact minimum height as indicated at 56C in FIG. 9. which enables the telescoped sections to be inserted in the top of a container in the form of the cereal box 21C. The sections 55C are dimensioned so that they may be expanded to define tubular structure 22C having an infinately adjustable length or height and once expanded the sections 55C are frictionally self held.

The container 21C may also be provided with marking means indicated by dotted lines at 60C in opposed walls thereof defining wall means 23C and 26C and upon cutting around the marking means 60C in opposed walls 23C and 26C the openings 25C and 30C respectively will be defined in such walls to enable the lower member 55C of the structure 22C to be inserted therethrough in snug fitting relation and in the manner illustrated in FIG. 10. Once the members 55C are expanded, essentially as shown in FIG. 8, a ball B may be placed thereon so that it may be readily hit with a ball bat, or the like.

The combination defining, the ball tee 20D is shown in FIG. 11 and is comprised of container means in the form of a container 21D especially designated for originally containing product means in the form of a plurality of balls each also designated by the reference numeral B. The container 21D has panels which may be readily opened for easy removal of the balls B from therewithin and then easily reclosed so that the container 21D may be used to define the base or support means of the associated tee 20D.

The container 21D may have simple openings of the type illustrated in the container 21C and for receiving and supporting an associated ball tee means or structure 22D; however, in this example such container has a supporting member or insert 61D suitably attached between a pair of opposed walls thereof. The insert 61D has a substantially right circular cylindrical central portion 62D and an outwardly offset portion 63D at each of its opposite ends.

Once the balls B are removed from within the container 21D, ball tee means in the form of a tubular structure 22D having a comparatively larger diameter outwardly extending flange portion 64D at one end thereof is inserted through the tubular support structure 61D so that the bottom annular surface 65D of the structure 22D is substantially coplanar with the bottom wall 66D of the container 21D and the top surface of the flange 64D engages an associated surface in the offset portion 63D to prevent the member 22D from being moved pulled away container 21D.

The ball tee means 22D may be in the form of a single piece tubular structure similar to the structure shown in FIG. 1 or may be comprised of a plurality of component parts which are arranged in telescoped relation and essentially of the type illustrated in FIG. 8.

Although the structure 22 may be made of a solid compressible material it is preferably a tubular structure which may be made of any suitable nonmetallic material such as cardboard, rubber, or other elastomeric materials such as thin walled plastic materials. The tubular structure comprising each of the tees 20, and 20A–20D of this invention is made of a transparent material which allows a ball B to be supported thereon and gives the illusion that the ball is suspended in mid air.

In one application of this invention a tubular structure 22 was made of a tubular protector normally utilized to protect golf club shafts when such golf clubs are being carried and stored within the usual golf bag. Such a golf club shaft tubular protector 22 was used with an easily compressible or easily mashed plastic milk container 21 having the configuration shown in FIG. 1. However, it will be appreciated that such a golf club shaft protector may be used with any of the containers disclosed therein.

The tee 20C is illustrated and described as being comprised of a container or carton 21C such as a cereal container. However, it would be appreciated that any suitable container may be used for this purpose regardless of the product originally contained therewithin provided that the size thereof is sufficiently large to support a tubular structure 22 in an upright manner, and in a manner described above, and sufficiently small to allow a young ball player to stand closely thereto to strike a ball from the associated tee.

Each of the container means or containers comprising the various tees of this invention may have suitable ballast means placed therewithin and such ballast means may be in the form of dirt, sand, or the like to provide added weight at the base of the associated tee and prevent such a tee from being knocked over readily. However, it will be appreciated that it is preferred that the tee be comparatively easily knocked over. In some instances, it may be desirable to provide suitable seal means so that a liquid such as water may be used as ballast.

in the case of the tee 20A water may be poured in the associated container 21A and a seal is not required. Further, in the case of the container 21A a suitable bracing device of any known construction may be inserted within the container 21A or defined as an inwardly extending part in the bottom wall to prevent lateral shifting of the bottom of the tubular structure 22A.

Thus, it is seen that the tee of this invention is a unique combination of container means originally utilized for containing product means of various types and ball tee means which may be especially designed for the purpose or of the type utilized as a golf club shaft protector. Such a unique tee may be obtained at minimum cost inasmuch as container means normally utilized around a household define a major component of such a ball tee. Accordingly, young ball players may concentrate on developing their batting skills or use such a tee in playing tee ball at minimum expense.

It will also be apparent that each of the other container means or containers such as 21M, 21A, 21B, 21C, and 21D may be provided with suitable markings similar to the arrow 34 illustrated in FIG. 1 to enable young ball players to concentrate on the direction in which to hit a ball B and on swinging a bat with a smooth level swing while keeping his or her eye on the ball with the back foot planted in a stationary manner yet moving the forward foot forwardly in the manner in which major league batting coaches often teach professional ball players.

It will be appreciated that to further assure a smooth level swing, the height of the ball-supporting tubular member, such as member 22, may be cut as desired. In the case of adjustable height structure 22C such height is simply adjusted.

While present exemplary embodiments of this invention, and methods of practicing the same, have been illustrated and described it will be recognized that this invention may be otherwise variously embodied and practiced within the scope of the following claims.

What is claimed is:

1. A method of making a baseball and softball ball tee comprising the steps of providing a conventional container means of a box or bottle type that originally contained a product therein and which has a top wall spaced from a bottom wall thereof by an enlarged chamber of said container means, telescopically disposing an elongated tubular ball support in an opening in said top wall of said container means by snuggly fitting the outer periphery of said ball support through said top wall at said opening so that said ball support is supported by said top wall snuggly engaging said ball support at said opening and said ball support extends substantially vertically out of the opening to a predetermined height thereabove whereby when said container means has said bottom wall disposed on a support surface said tubular ball support will be disposed in an upright manner so that a ball having an external diameter within the range of the diameter of a standard baseball to the diameter of a standard softball can be hit off of the upper end thereof in a ball strike zone which is at least equal to a vertical height defined by the batter's knees, and stabilizing the lower end of said tubular ball support with said bottom wall of said container means so that both the top and bottom walls of said container means support said tubular ball support in said upright manner.

2. A method as set forth in claim 1 wherein said step of stabilizing said lower end of said tubular ball support with said bottom wall of said container means comprises the step of forming an opening in said bottom wall and telescopically disposing said lower end of said tubular ball support in said opening of said bottom wall.

3. A method as set forth in claim 2 wherein said step of forming said opening in said bottom wall of said container means comprises the step of forming said opening in said bottom wall in aligned relation with said opening in said top wall.

4. A method as set forth in claim 2 and including the step of abutting an annular rim at the lower end of said tubular ball support against the outside of said bottom wall outboard of said opening in said bottom wall so that said lower end of said ball support cannot be readily pulled out of said container means in a direction toward said top wall thereof.

5. A method as set forth in claim 1 wherrein said step of stabilizing said lower end of said tubular ball support with said bottom wall of said container means comprises the step of abutting said lower end of said tubular ball support against the inside surface of said bottom wall.

6. A method as set forth in claim 1 wherein said container means comprises a jug-like container that has a pour spout in the top wall thereof, said pour spout providing said opening in said wall thereof.

7. A method as set forth in claim 1 wherein said step of providing said container means comprises the step of providing a rectangular container means having said opening in a wall thereof that will form said top wall thereof to support said tubular ball support.

8. A method as set forth in claim 1 and including the step of adding ballast inside said container means to provide weight to said ball tee.

9. A method as set forth in claim 8 wherein said step of adding ballast inside said container means comprises the step of disposing granular material inside said container means.

10. A method as set forth in claim 8 wherein said step of adding ballast inside said container means comprises the step of disposing a liquid inside said container means.

* * * * *